US006971871B2

(12) United States Patent
Ahmady

(10) Patent No.: US 6,971,871 B2
(45) Date of Patent: Dec. 6, 2005

(54) VARIABLE LOW INTENSITY INFRARED HEATER

(75) Inventor: Farshid Ahmady, Rochester Hills, MI (US)

(73) Assignee: Solaronics, Inc., Rochester, MI (US)

( * ) Notice: Subject to any disclaimer, the term of this patent is extended or adjusted under 35 U.S.C. 154(b) by 0 days.

(21) Appl. No.: 10/774,025

(22) Filed: Feb. 6, 2004

(65) Prior Publication Data

US 2005/0175944 A1 Aug. 11, 2005

(51) Int. Cl.[7] ..... F23C 5/08
(52) U.S. Cl. ..... 431/180
(58) Field of Search ..... 431/11, 12, 19, 431/25, 180, 329, 346, 351; 126/91 A, 116 A; 236/2 R, 11

(56) References Cited

U.S. PATENT DOCUMENTS

| | | | | |
|---|---|---|---|---|
| 2,048,162 | A | 7/1936 | Kriechbaum | |
| 2,672,291 | A | 3/1954 | Rifle | |
| 2,751,893 | A | 6/1956 | Permann | |
| 2,784,913 | A | 3/1957 | Wasson | |
| 3,369,751 | A | 2/1968 | Howe | |
| 3,486,732 | A | 12/1969 | Freeby et al. | |
| 3,741,710 | A | 6/1973 | Nelson | |
| 3,843,049 | A | 10/1974 | Baysinger | |
| 3,969,069 | A | 7/1976 | Knaak | |
| 4,390,125 | A | 6/1983 | Rozzi | |
| 4,425,930 | A | 1/1984 | Kruto | |
| 4,521,183 | A | 6/1985 | Hirai et al. | |
| 4,645,450 | A | 2/1987 | West | |
| 4,716,883 | A | 1/1988 | Johnson | |
| 4,869,229 | A | 9/1989 | Johnson | |
| 4,932,430 | A | 6/1990 | Fernstrom | |
| 4,951,649 | A | 8/1990 | Inouchi | |
| 5,022,460 | A | 6/1991 | Brown | |
| 5,027,789 | A | 7/1991 | Lynch | |
| 5,076,781 | A | 12/1991 | Cremers | |
| 5,112,217 | A | 5/1992 | Ripka et al. | |
| 5,211,331 | A | 5/1993 | Seel | |
| 5,271,556 | A | 12/1993 | Helt et al. | |
| 5,353,986 | A | 10/1994 | Wortman et al. | |
| 5,361,750 | A | 11/1994 | Seel et al. | |
| 5,732,691 | A * | 3/1998 | Maiello et al. | 126/116 A |

(Continued)

FOREIGN PATENT DOCUMENTS

| | | |
|---|---|---|
| CA | 1292670 | 12/1991 |
| GB | 2 263 542 A | 7/1993 |

OTHER PUBLICATIONS

International Approval Services Certification Report No. C2895002, Revised Jan. 06, 1994.

*Primary Examiner*—Stephen Gravini
(74) *Attorney, Agent, or Firm*—Young & Basile

(57) ABSTRACT

A radiant heater including a burner having an inlet for receiving an air and gas mixture and an exhaust for emitting exhaust gases generated by combustion of the air and gas mixture within the burner, an elongated radiant heating tube having an inlet for receiving the exhaust gases emitted by the burner, a gas flow control assembly for controlling the flow of gas to the burner, and a blower for controlling the flow of air to the burner. The blower comprises a two-stage blower including a motor having a low winding corresponding to a low blower speed and a high winding corresponding to a high blower speed. The gas flow control assembly comprises a two-stage regulator or two-stage valve having a low setting for delivering a low gas flow to the burner and a high setting for delivering a high gas flow to the burner.

22 Claims, 6 Drawing Sheets

U.S. PATENT DOCUMENTS 5,989,011 A * 11/1999 Caruso et al. ..... 431/12
6,027,333 A * 2/2000 Fujii et al. ..... 431/215
6,029,647 A 2/2000 Pisano et al.
6,282,910 B1 * 9/2001 Helt ..... 62/229
RE37,636 E 4/2002 Wortman et al.

* cited by examiner

FIG - 1
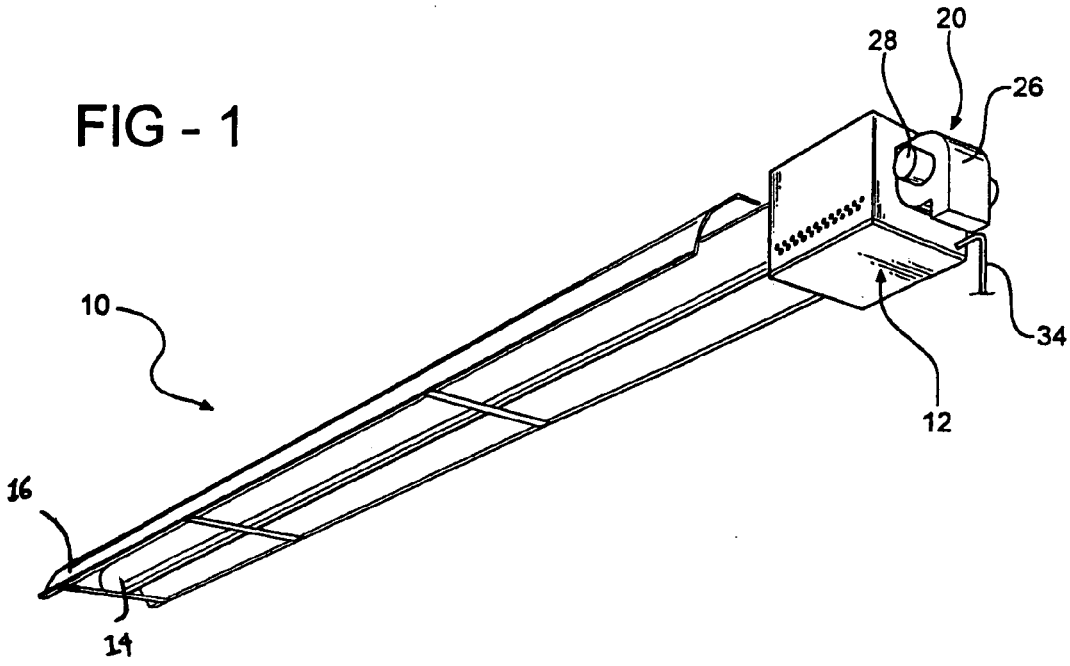
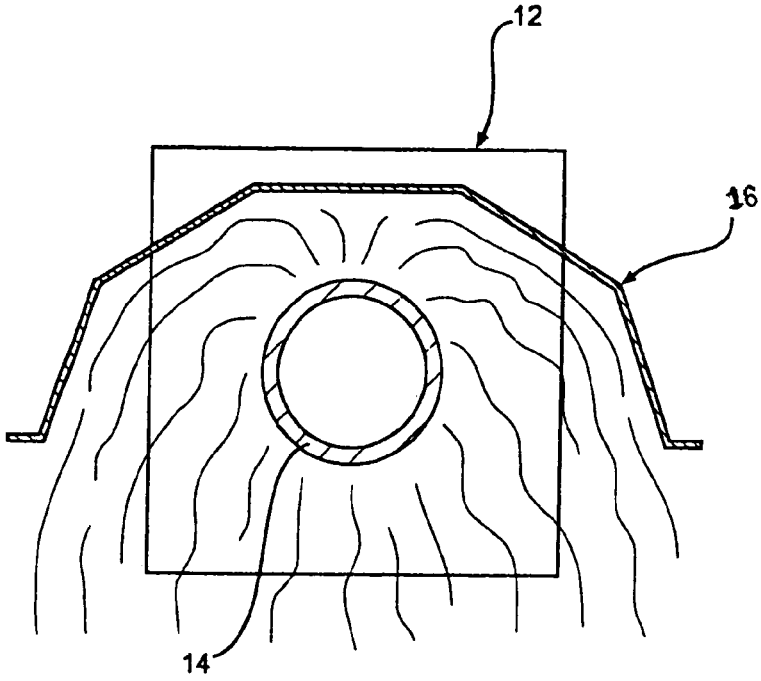
FIG - 2

VARIABLE LOW INTENSITY INFRARED HEATER

FIELD OF THE INVENTION

This invention relates to an apparatus and method for heating an enclosed space with a variable low intensity infrared heater.

BACKGROUND OF THE INVENTION

Gas fired infrared heaters typically are used in large industrial settings. A gas heater burns natural gas, propane, or similar combustible gases and the combustion by-products or exhaust gases are passed through a radiant heating tube which becomes hot and radiates energy waves therefrom. Reflectors are often used to reflect the energy waves toward the desired location usually toward the floor where the infrared energy waves are converted into heat. These low intensity infrared heaters generally operate at full capacity when not in an off condition with the result that the burner constantly cycles between its on condition and its off condition, thus making it difficult to control heating levels.

There have been some attempts to create a two-stage heater by utilizing a single gas flow control assembly with two pressure settings with a single speed blower. The problem with this system is that even though the gas pressure, and therefore the gas volume, is varied between the two stages, the blower speed is constant. As a result at both high and low stages the volume of air is the same. Therefore there is either too much air for a low stage or too little air for the high stage resulting in low efficiency combustion. Practically, since these systems idle most of the time at low stage, the excess air results in low efficiency operation and a great amount of wasted energy. Further, since a single gas flow control assembly valve is utilized, it is difficult to achieve an accurate setting for either the high or low level operation.

SUMMARY OF THE INVENTION

This invention is directed to the provision of improved, more efficient radiant heater.

The radiant heater of the invention is of the type including a burner having an inlet for receiving an air and gas mixture and an exhaust for emitting exhaust gases generated by combustion of the air and gas mixture within the burner; an elongated radiant heating tube having an inlet for receiving the exhaust gases emitted by the burner; a gas valve for controlling the flow of gas to the burner; and a blower for controlling the flow of air to the burner. According to the invention, the blower comprises a two-stage blower having a low speed for delivering a low air flow to the burner and a high speed for delivering a high air flow to the burner. This arrangement allows for a proper and fixed air/gas ratio for both high- and low-stage operation of the burner.

According to a further feature of the invention, the blower includes an electric motor having a low winding corresponding to the blower low speed and a high winding corresponding to the blower high speed. This arrangement provides a ready and efficient means of providing the two levels of blower operation.

According to a further feature of the invention, the gas flow control assembly includes a two-regulator assembly or a two-valve assembly, each having a different setting, one a low setting for delivering a low gas flow to the burner and the other having a high setting for delivering a high gas flow to the burner. This arrangement, utilizing a two-stage blower in combination with a two-stage gas flow control assembly, allows for precise control of the desired air/gas ratio for both high- and low-level operation.

According to a further feature of the invention, the valve assembly includes two valves for independently controlling gas flow from a source to the burner. This arrangement allows for precise control of the gas flow volumes provided in the high and low level operational stages.

The invention also provides a method of heating a room with an infrared heater of the type including a burner having an inlet for receiving an air and gas mixture and an exhaust for emitting exhaust gases generated by combustion within the burner; and an elongated radiant heating tube having an inlet for receiving the exhaust gases emitted by the burner.

According to the invention methodology, a two-stage gas valve is provided having a low setting for delivering a low gas flow to the burner and a high setting for delivering a high gas flow to the burner. A two stage blower is provided having a low speed for delivering a low air flow to the burner and a high speed for delivering a high air flow to the burner; and the blower is operated at the low speed when the gas flow control assembly is operating at the low setting and at the high speed when the regulator is operating at the high setting. This methodology allows precise air/gas ratios to be provided at both the high- and low-level operational stages of the burner.

According to a further feature of the invention methodology, a temperature set point is defined for the room, a programmed temperature differential is defined, the temperature of the room is monitored, and the burner is ignited when the room temperature is less than the temperature set point. A temperature threshold is defined as the temperature set point minus the temperature differential. The blower is operated at the high level when the room temperature is equal to or below the temperature threshold, and the blower is operated at the low level when the room temperature is greater than the temperature threshold and lower than the set point temperature. This arrangement provides a ready and convenient means of providing high level operation when the room is relatively cold relative to the set point temperature and providing low level operations when the room temperature is close to the set point temperature.

According to a further feature of the invention methodology, the regulator is a two-stage regulator and the method includes the further step of operating the regulator at a high level when the blower is operating at the high level and operating the regulator at a low level when the blower is operating at the low level. This methodology allows precise air/gas ratios to be provided at both the high and low level operational stages of the burner.

According to a further feature of the invention methodology the gas flow control assembly has either of two valves or two regulators operating in parallel and the method includes the step of opening one valve or regulator and closing one valve or regulator when the regulator is operating at the low level and opening both valves or regulators when the gas flow control assembly is operating at the high level. It is understood that also one valve or regulator could provide a higher flow such that one valve or regulator is used for the low setting and the other for a high setting. This methodology allows for precise control of the volume of gas delivered at both the low level and the high level operational stages.

BRIEF DESCRIPTION OF THE DRAWINGS

The description herein makes reference to the accompanying drawings wherein like reference numerals refer to like parts throughout the several views, and wherein:

FIG. 1 is a perspective view of a radiant heater according to the invention;

FIG. 2 is a cross section of the heater schematically showing reflected energy waves;

DESCRIPTION OF THE PREFERRED EMBODIMENT

Figure 3:
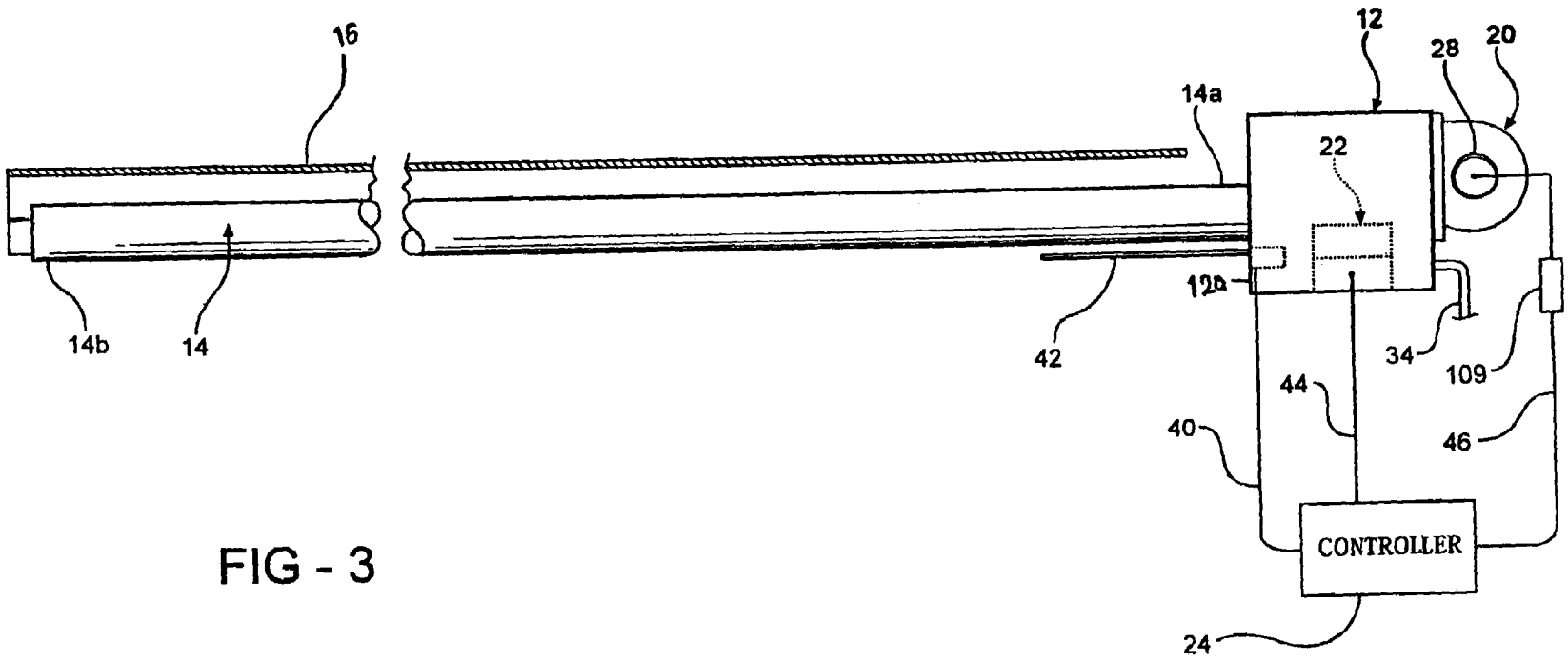
FIG. 3 is a side elevational view of the heater.

The infrared heater 10 of the invention, broadly considered, includes a housing 12, a radiant tube 14, a reflector 16, a burner 18 (shown only in FIG. 4), a blower 20, a gas flow control assembly 22, and a controller 24 (shown only in FIG. 3).

Housing 12 has a box like sheet metal configuration.

Figure 4:
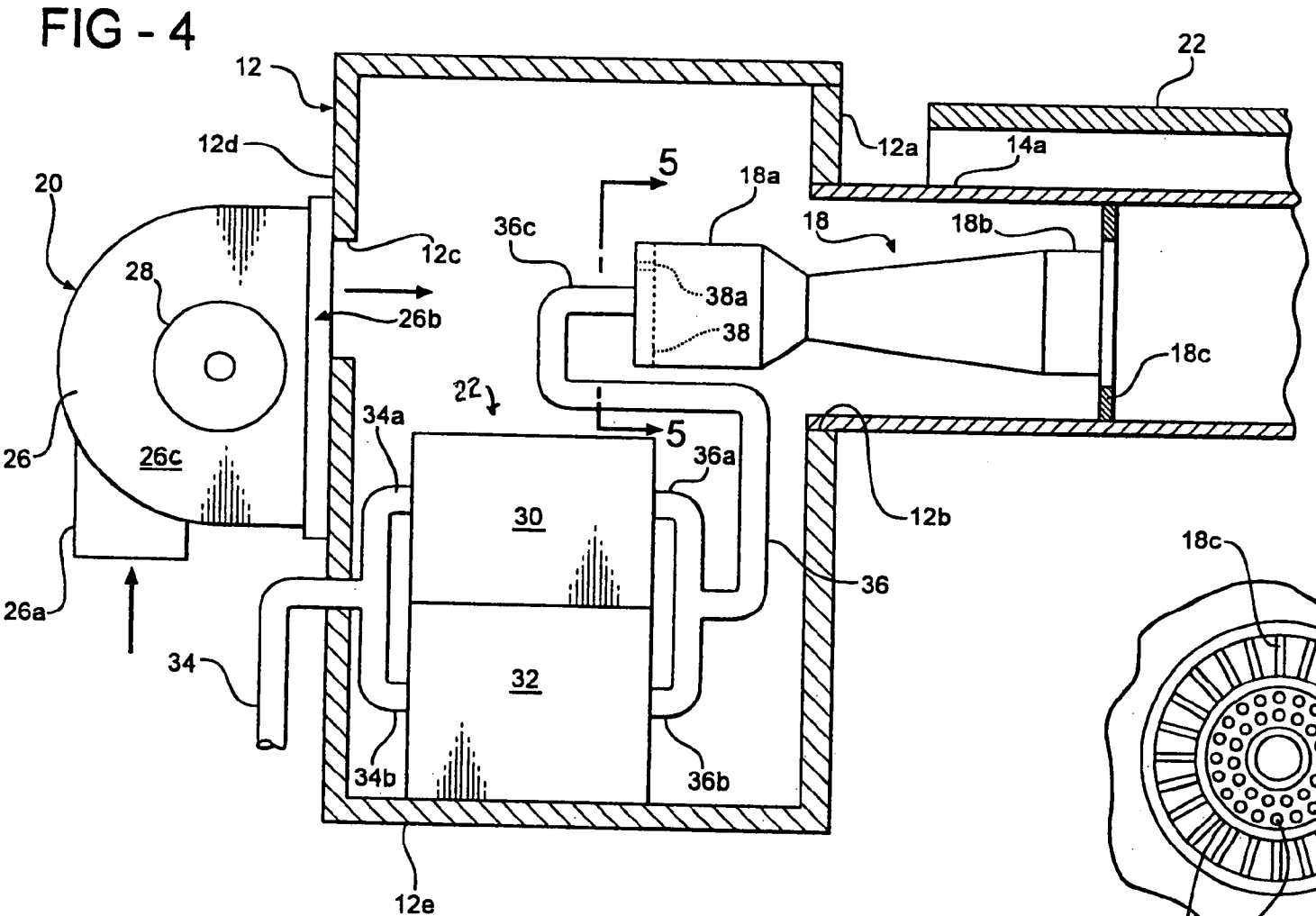
FIG. 4 is a fragmentary, cross-sectional, somewhat schematic view of the heater.

Radiant tube 14 is elongated and includes an inlet end 14*a* secured to a front wall 12*a* of housing 12, in communication with a wall aperture 12*b* as shown in detail in FIG. 4. Radiant tube 14 also includes an exhaust end 14*b* as shown in FIG. 3.

Reflector 16 has an inverted U configuration in cross-section, is suitably supported in spaced overlying relation to tube 14, and is generally coextensive with tube 14.

Figure 5:
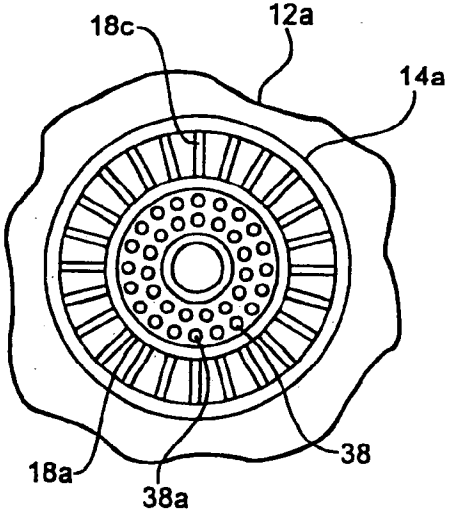
FIG. 5 is a cross-sectional view taken on line 5—5 of FIG. 4.

As shown in FIGS. 4 and 5, burner 18 is elongated and generally tubular, has a venturi configuration, and includes an inlet end 18*a* positioned in housing 12 proximate wall 12*a* and an outlet end 18*b* positioned in the inlet end 14*a* of tube 14 and centered concentrically within the tube by a plurality of circumferentially spaced spokes or vanes 18*c*.

Blower 20 is a centrifugal blower and includes a housing 26 and an electric motor 28 mounted on a side wall 26*c* of the housing and driving the blower scroll or impeller in a known manner. Housing 26 includes an air inlet 26*a* and an air exhaust 26*b* communicating with an aperture 12*c* in housing rear wall 12*d* whereby actuation of the blower discharges pressurized air into the interior of the housing 12.

Motor 28 is a two-speed motor having a high winding and a low winding so that the blower comprises a two-stage blower having a low speed for delivering a low air flow to housing 12 and burner 18 and a high speed for delivering a high air flow to housing 12 and burner 18. Motor 28 may for example comprise a 1/25 HP, 110 V AC single phase 60 hz motor and may be operative to deliver a low air flow of 25 CFH and a high air flow of 50 CFH.

Figure 6:
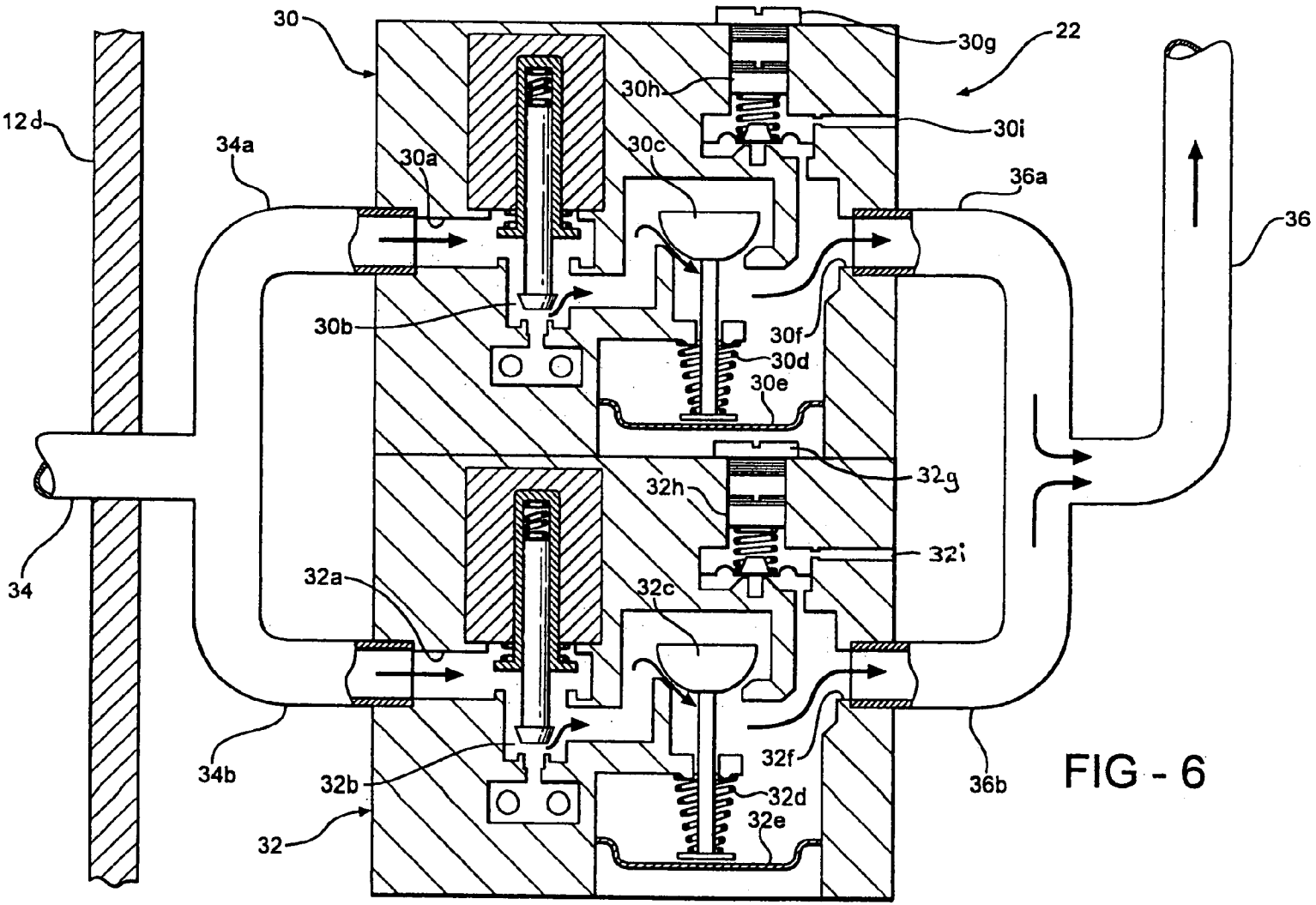
FIG. 6 is a detail cross-sectional view of a gas flow control assembly utilized in the heater.
Figure 6A:
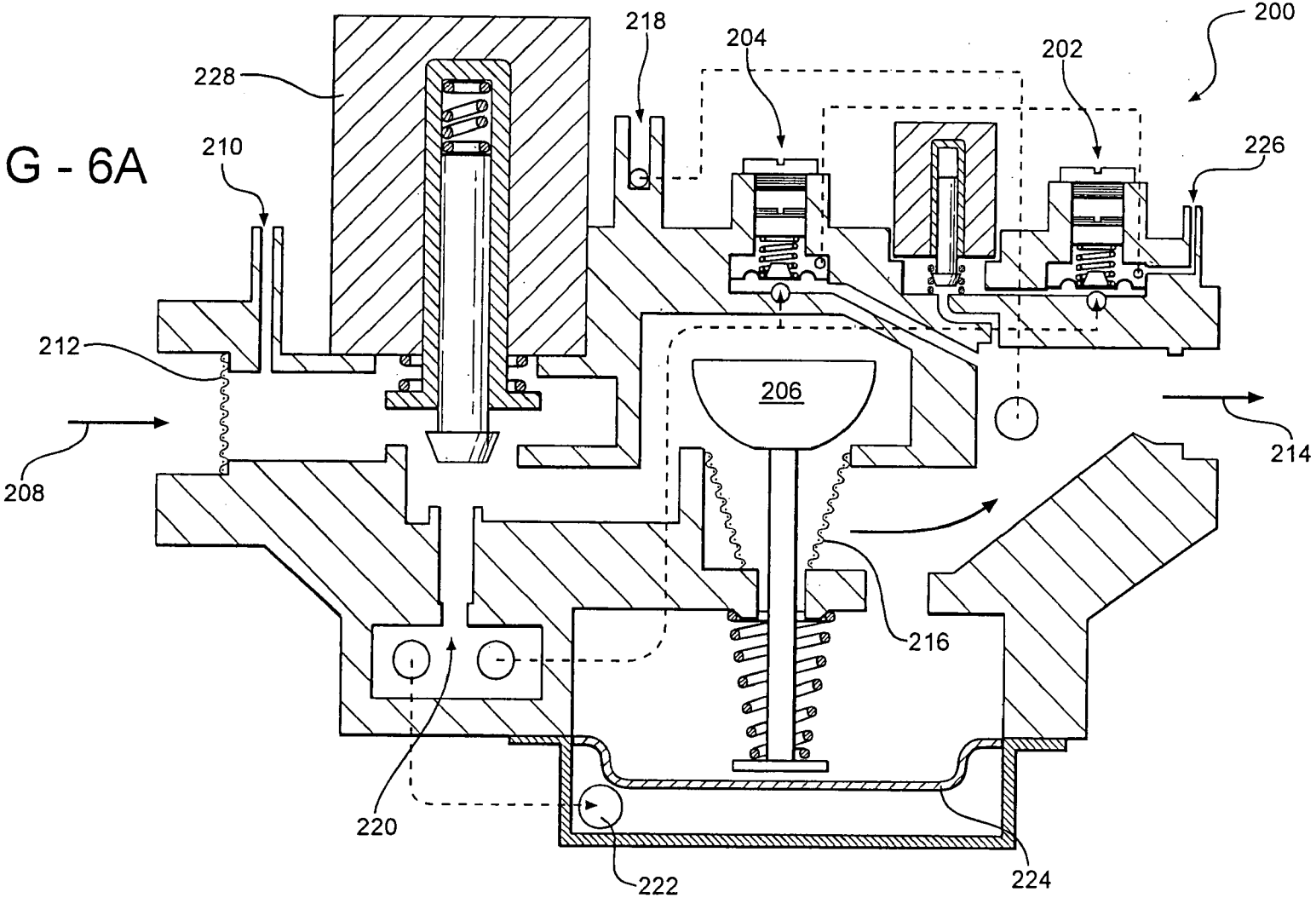
FIG. 6A is a detail cross-sectional view of an alternate gas flow control assembly utilized in the heater.

Gas flow control assembly 22 may be supported within housing 12 on housing lower wall 12*e* and comprises either a two-stage regulator or a two-stage valve with the two stages achieved by the use of two independent valves 30 and 32 as shown in FIGS. 4 and 6 or two regulators 202 and 204 arranged in parallel within a common housing as shown in FIG. 6A.

Valve 30 includes a gas inlet 30*a*, a redundant solenoid valve 30*b*, a main valve 30*c* controlled by a spring 30*d* and a diaphragm 30*e*, a gas outlet 30*f*, a cap screw 30*g*, an adjustment screw 30*h*, and a vent 30*i*.

Valve 32 is identical to valve 30 as indicated by the like reference numbers 32*a*–32*i*.

Main valves 30*c* and 32*c* are controlled in known manner by solenoids and each valve is moveable between first and second positions corresponding to the valve being 100% closed and 100% open respectively.

In the assembled burner package shown in FIG. 4, blower 20 is mounted on rear housing wall 12*d* with the blower outlet 26*b* aligned with housing wall aperture 12*c*. The regulator assembly 22 is mounted on housing lower wall 12*e* within housing 12. A gas inlet line 34 passes through housing rear wall 12*d* and thereafter bifurcates to form a first branch 34*a* communicating with the inlet 30*a* of valve 30 and a second branch 34*b* communicating with the inlet 32*a* of valve 32. Branch gas outlet lines 36*a* and 36*b* communicate respectively with the outlet 30*f* of valve 30 and the outlet 32*f* of valve 32 and thereafter converge to form gas outlet line 36, which extends within housing 12 to a free end 36*c* fixedly and centrally secured to an annular disk 38*a* positioned at the inlet end 18*a* of burner 18 and defining a plurality of perforations 38*a* shown in FIG. 5.

Controller 24, shown in FIG. 3, may be mounted on housing 12 and is connected by a lead 40 to a two-stage thermostatic probe 42 carried by housing 12. The controller 24 provides a reading of room temperature from the probe 42 to regulator 22 by a lead 44 and to the high and low windings of motor 28 of blower 20 by a lead 46.

With respect to the general overall operation of the heater, gas is supplied to the interior of burner 18 via line 36, and air is supplied to the burner 18 via blower 20 with the air from the blower 20 entering into the interior of the venturi through the perforations 38*a* for mixture with the gas. Air also passes into tube inlet end 14*a* outwardly of the venturi for passage through vanes 18*c*, which act to impart a swirl to the air to facilitate the air/gas nixing. It will be understood that ignition is accomplished in a known manner by a pilotless direct spark utilizing an ignition module (not shown) and that burner operation is monitored and controlled in a known manner by an ignition detection control (not shown).

Figure 7:
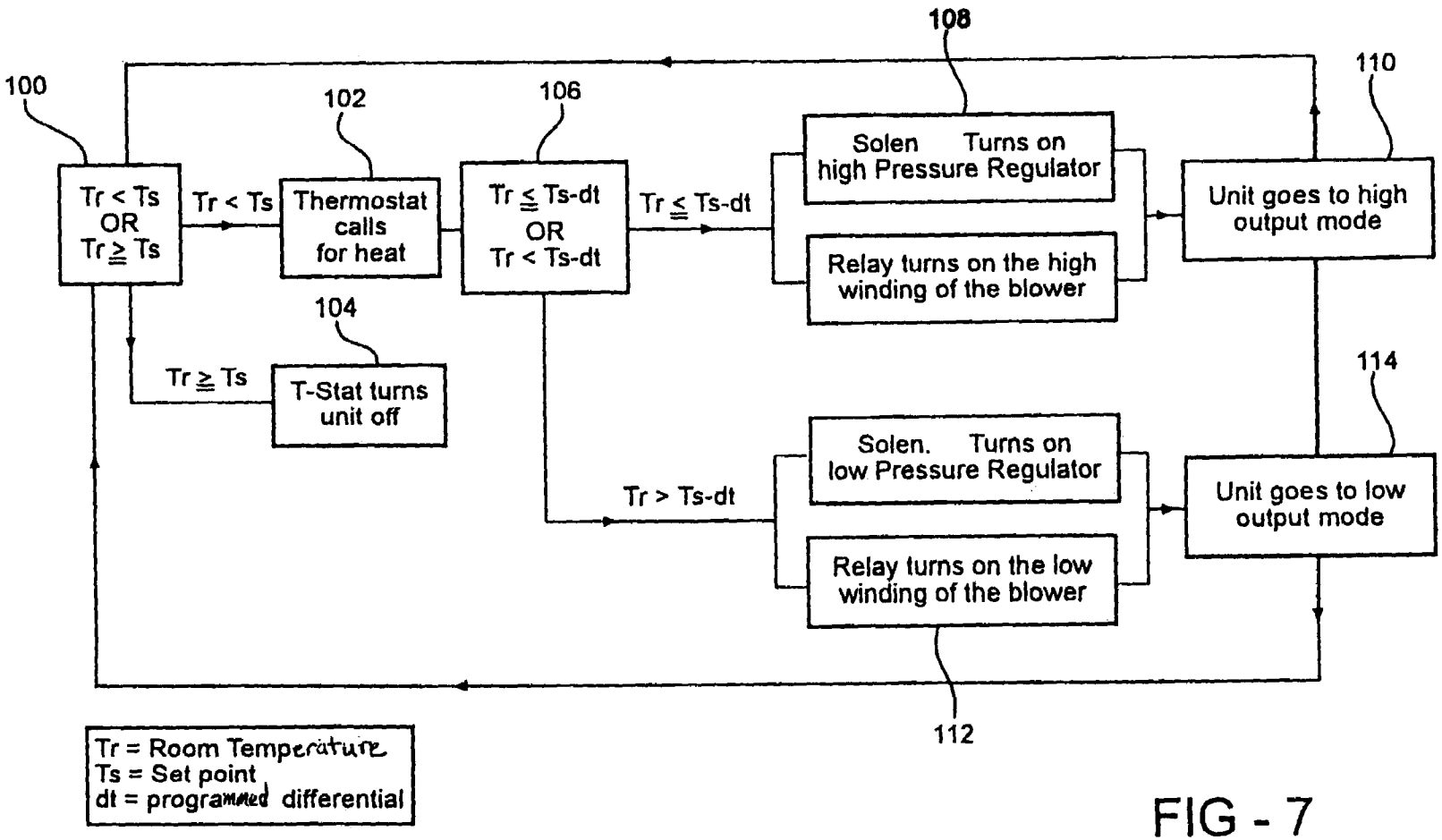
FIG. 7 is a flow chart showing the operation of the heater.

The specific operation of the invention heater is best understood with reference to FIG. 7. The flow sequence for the invention heater begins by defining a set point temperature $T_s$ and a programmed differential $d_t$ and comparing these values to the room temperature $T_r$ as determined by the thermostatic probe 42 and as recognized by controller 24. This comparison is shown at step 100 in FIG. 7. If the room temperature $T_r$ is less than the set point temperature $T_s$ the thermostat calls for heat in step 102. If the room temperature $T_r$ is greater than or equal to the set point temperature $T_s$ the controller will turn the unit off as shown in step 104. Once the thermostat calls for heat in step 102, the controller calculates whether the room temperature $T_r$ is less than or equal to the temperature set point $T_s$ minus the programmed differential $d_t$, or whether the room temperature $T_r$ is greater than the temperature set point $T_s$ minus the programmed differential $d_t$. This calculation is shown as step 106.

If the room temperature $T_r$ is less than or equal to the temperature set point $T_s$ minus the programmed differential $d_t$, the controller, as shown in step 108, commands a high gas flow rate from the gas regulator by energizing solenoids to move both valves 30*c* and 32*c* to their second, fully-opened positions, and commands a high air flow rate from the blower by energizing a relay 109 (shown in FIG. 3) in a sense to power the high winding of blower motor 28. The heater 10 is now in a high output mode as shown in step 110 and then loops back to step 100 to continuously monitor the room temperature $T_r$ relative to the set point temperature $T_s$.

If the room temperature $T_r$ is greater than the set point temperature $T_s$ minus the programmed differential $d_t$, in step 106, the controller, as shown in step 112, commands a low gas flow rate from the gas regulator by energizing solenoids to move valve 30*c* to the second, open position and move valve 32*c* to the first, closed position, and commands a low air flow rate from the blower by energizing the relay 109 in a sense to power the low winding of the blower motor 28. The heater 10 is now in a low output mode as shown in step 114 and then loops back to step 100 to continuously monitor the room temperature $T_r$ for comparison with the temperature set point $T_s$. It will be understood that if the heater is initially operated at the high output level, when the room temperature $T_r$ reaches the set point temperature $T_s$ minus the temperature differential $d_t$, the controller will operate to place the heater in the low output mode by switching the blower motor 28 to the low winding and closing valve 32*c*. When the room temperature eventually reaches the set point temperature $T_s$, the controller shuts off the heater and allows the blower to stay on for a few minutes to purge any flue gases left in the system.

With reference to FIG. 6A, another preferred two-stage gas regulator 200 is illustrated. Gas flow control assembly 200 may for example be of the type available from White Rogers of St. Louis, Mo. sold under the brand name Two Stage Gemini. As shown, the gas flow control assembly includes a low-fire regulator 202 and a high-fire regulator 204. Low-fire and high-fire regulators 202 and 204 work in combination with main valve 206 to provide two-stage gas control. The regulator body includes an inlet 208 and associated inlet pressure tap 210 and inlet screen 212. Gas exits the assembly 200 at outlet 214. Outlet 214 includes an associated outlet pressure tap 218 and outlet screen 216. The assembly 200 includes a control gas orifice 220 and associated orifice opening 222. Main valve 206 is biased by diaphragm 224 in a manner known to those of skill in the art. The assembly 200 includes a vent 226 and redundant solenoid 228.

It is understood by those of skill in the art that the assembly illustrated in FIG. 6A could be substituted for the assembly illustrated in FIG. 6. In particular, where FIG. 6 illustrates an assembly in which valves 30*c* and 32*c* selectively cooperate to provide two levels of gas flow, FIG. 6A illustrates an assembly in which low-fire regulator 202 and high-fire regulator 204 operate to deliver two gas flows.

When the temperature drops below the set point, yet still stays above the set point temperature minus the programmed differential, the low stage of the heater comes back on until the thermostat is satisfied. The system idles around the set point on the low stage, on and off, preventing any overshoot effect with otherwise a high heating inertia. However, if there is a sudden drop in the room temperature for any reason the heater comes on with high stage allowing a fast recovery.

The invention, by utilizing a two-stage blower and a two-stage gas flow control assembly, allows for a proper and fixed air/gas ratio for both the high and low output levels. This arrangement has the advantages of saving energy by operating with optimum gas/air ratios at all times; saving energy by reducing the temperature overshoots due to the high heat inertia; reducing wear and tear on the components by eliminating unnecessary cycling of the unit on high heat; providing accurate constant rate for each stage due to the two independent valves or regulators; allowing for a higher differential between the two stages due to the independent regulator adjustment; and reducing the cost of the heater by eliminating the need for an expensive, continuously variable blower motor providing a continuously variable blower speed.

The gas flow control assemblies disclosed in the present embodiments provide a much more accurate two-stage flow control as compared to the gas flow control assemblies of the prior art.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An infrared heater comprising:

a burner having an inlet for receiving air and gas and an exhaust for emitting exhaust gases generated by combustion of a mixture of the air and the gas within the burner;

an elongated radiant heating tube having an inlet for receiving the exhaust gases emitted by the burner;

a gas flow control assembly for controlling the flow of gas to the burner; and a blower receiving inlet air and directing the inlet air to the inlet of the burner wherein the blower comprises a two stage blower having a low speed for delivering a low air flow to the burner and a high speed for delivering a high air flow to the burner.

2. An infrared heater according to claim 1 wherein the blower includes an electric motor having a low winding corresponding to the blower low speed and a high winding corresponding to the blower high speed.

3. An infrared heater according to claim 1 wherein the gas flow control assembly comprises a two stage gas regulator having a low setting for delivering a low gas flow to the burner and a high setting for delivering a high gas flow to the burner.

4. An infrared heater according to claim 3 wherein the gas flow control assembly includes two valves for controlling gas flow from a source to the burner.

5. An infrared heater according to claim 4 wherein the valves control flow independently through two parallel paths.

6. An infrared heater according to claim 5 wherein the gas flow control assembly receives gas from one inlet supply path and splits the gas flow into two paths corresponding to the two valves.

7. An infrared heater according to claim 6 wherein the two gas flow paths converge back into one flow path after passing through the regulator.

8. An infrared heater according to claim 5 wherein each valve has a first and a second position.

9. An infrared heater according to claim 8 wherein the first and second positions correspond to the valve being 100% closed and 100% open respectively.

10. An infrared heater according to claim 9 wherein each valve is controlled to the second position when the regulator is operating at the high setting.

11. An infrared heater according to claim 10 wherein one valve is controlled to the second position and the other valve is controlled to the first position when the regulator is operating at the low level.

12. An infrared heater according to claim 2 wherein the blower operates at the high speed when the gas regulator is operating at the high setting.

13. An infrared heater according to claim 2 wherein the blower operates at the low speed when the gas regulator is operating at the low setting.

14. An infrared heater comprising:

a burner for receiving and combusting an air and gas mixture to generate exhaust gases;

a radiant heating tube receiving the exhaust gases from the burner and converting the exhaust gases into radiant heat;

a two stage gas flow control assembly operative to deliver gas to the burner at either a low level or a high level; and a two stage blower operative to deliver air to the burner at either a low level or a high level.

15. An infrared heater according to claim 14 wherein the blower operates at the high level when the gas regulator is operating at the high level and the blower operates at the low level when the gas regulator is operating at the low level.

16. An infrared heater according to claim 14 wherein the gas flow control assembly includes two valves for controlling gas flow from a source to the burner.

17. An infrared heater according to claim 14 wherein the blower includes a motor having a low winding corresponding to the low level blower operation and a high winding corresponding to the high level blower operation.

18. A method of heating a room with an infrared heater of the type including a burner having an inlet for receiving air and gas, and an exhaust for emitting exhaust gases generated by combustion within the burner, and an elongated radiant heating tube located in the room to be heated and having an inlet for receiving the exhaust gases emitted by the burner, a two stage gas regulator having a low setting for delivering a low gas flow to the burner and a high setting for delivering a high gas flow to the burner; and a two stage blower having a low speed for delivering a low air flow to the inlet of the burner and a high speed for delivering a high air flow to the inlet of the burner wherein the method comprises the steps of;

(i) operating the blower at the low speed while operating the regulator at the low setting to heat the room; and (ii) operating the blower at the high speed while operating the regulator at the high setting to heat the room.

19. A method according to claim 18 wherein the method includes the further steps of:

defining a temperature set point of the room;

defining a programmed temperature differential;

monitoring the temperature of the room;

igniting the burner when the room temperature is less than the temperature set point;

defining a temperature threshold as the temperature set point minus the temperature differential;

operating the blower at the high speed and the regulator at the high setting when the room temperature is equal to or below the temperature threshold; and operating the blower at the low speed and the regulator at the low setting when the room temperature is greater than the temperature threshold and lower than the set point temperature.

20. A method according to claim 18 wherein the regulator has two valves operating in parallel and wherein the method includes the step of opening one valve and closing one valve when the regulator is operating at the low setting and opening both valves when the regulator is operating at the high setting.

21. A method of heating a room with an infrared heater of the type including a burner having an inlet for receiving an air and gas mixture and an exhaust for emitting exhaust gases generated by combustion within the burner, an elongated radiant heating tube having an inlet for receiving the exhaust gases emitted by the burner, a gas flow control assembly for controlling the flow of gas to the burner, and a two stage blower for controlling the flow of air to the burner, the method comprising the steps of:

defining a temperature set point of the room;

defining a programmed temperature differential;

monitoring the temperature of the room;

igniting the burner when the room temperature is less than the temperature set point;

defining a temperature threshold as the temperature set point minus the temperature differential;

operating the blower at the high level when the room temperature is equal to or below the temperature threshold; and operating the blower at the low level when the room temperature is greater than the temperature threshold and lower than the set point temperature.

22. A method according to claim 21 wherein the gas flow control assembly is a two stage regulator and wherein the method includes the further step of operating the regulator at a high level when the blower is operating at the high level and operating the regulator at a low level when the blower is operating at a low level.

* * * * *

US006971871C1

(12) EX PARTE REEXAMINATION CERTIFICATE (7261st)

United States Patent

Ahmady

(10) Number: US 6,971,871 C1

(45) Certificate Issued: Dec. 22, 2009

(54) VARIABLE LOW INTENSITY INFRARED HEATER

(75) Inventor: Farshid Ahmady, Rochester Hills, MI (US)

(73) Assignee: Solaronics, Inc., Rochester, MI (US)

Reexamination Request:
No. 90/009,045, Apr. 11, 2008

Reexamination Certificate for:

| | |
|---|---|
| Patent No.: | **6,971,871** |
| Issued: | **Dec. 6, 2005** |
| Appl. No.: | **10/774,025** |
| Filed: | **Feb. 6, 2004** |

(51) Int. Cl.
*F23C 5/08* (2006.01)

(52) U.S. Cl. ..... 431/180

(58) Field of Classification Search ..... None
See application file for complete search history.

(56) References Cited

U.S. PATENT DOCUMENTS

| | | | | |
|---|---|---|---|---|
| 3,399,833 | A | 9/1968 | Johnson | |
| 4,334,855 | A | 6/1982 | Nelson | |
| 5,211,331 | A | 5/1993 | Seal | |
| 5,353,986 | A | 10/1994 | Wortman et al. | |
| 5,732,691 | A | 3/1998 | Maiello et al. | |
| 6,786,225 | B1 * | 9/2004 | Stark et al. | 137/1 |
| 2003/0030392 | A1 * | 2/2003 | Neranjan et al. | 318/34 |

* cited by examiner

*Primary Examiner*—Cary E. O'Connor

(57) ABSTRACT

A radiant heater including a burner having an inlet for receiving an air and gas mixture and an exhaust for emitting exhaust gases generated by combustion of the air and gas mixture within the burner, an elongated radiant heating tube having an inlet for receiving the exhaust gases emitted by the burner, a gas flow control assembly for controlling the flow of gas to the burner, and a blower for controlling the flow of air to the burner. The blower comprises a two-stage blower including a motor having a low winding corresponding to a low blower speed and a high winding corresponding to a high blower speed. The gas flow control assembly comprises a two-stage regulator or two-stage valve having a low setting for delivering a low gas flow to the burner and a high setting for delivering a high gas flow to the burner.

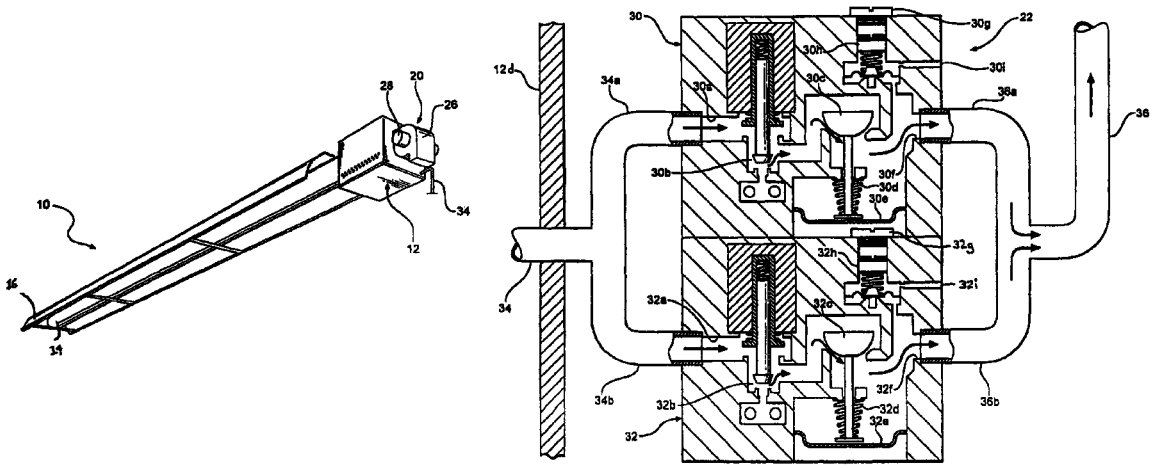

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 14, 18 and 21 are determined to be patentable as amended.

Claims 2–13, 15–17, 19, 20 and 22, dependent on an amended claim, are determined to be patentable.

1. An infrared heater comprising:

*a housing having an interior and an exterior;* a burner *positioned within the interior of the housing, the burner* having an inlet for receiving air and gas and an exhaust for emitting exhaust gases generated by combustion of a mixture of the air and the gas within the burner;

an elongated radiant heating tube *extending from the housing* having an inlet for receiving the exhaust gases emitted by the burner *and for emitting heat*;

a *two position* gas flow control assembly for controlling the flow of gas to the burner *at a low setting and at a high setting*; and a blower *positioned on the exterior of the housing, the blower* receiving inlet air and directing the inlet air *into the housing* to the inlet of the burner wherein the blower comprises a two stage blower having a low speed for delivering a low air flow to the burner *when the gas control assembly is at its low setting* and a high speed for delivering a high air flow to the burner *when the gas control flow assembly is at its high setting*.

14. An infrared heater comprising:

*a housing having an interior and an exterior;* a burner *positioned within the interior of the housing, and* for receiving and combusting an air and gas mixture to generate exhaust gases; a radiant heating tube receiving the exhaust gases from the burner and converting the exhaust gases into radiant heat;

a two stage gas flow control assembly operative to deliver gas to the burner at either a low level or a high level;

and a two stage blower *positioned on the exterior of the housing* operative to deliver air to the burner at either a low level or a high level.

18. A method of heating a room with an infrared heater of the type including a *housing having and interior and an exterior and a* burner *positioned within the housing and* having an inlet for receiving air and gas, and an exhaust for emitting exhaust gases generated by combustion within the burner, and an elongated radiant heat tube *extending from the housing and* located in the room to be heated and having an inlet for receiving the exhaust gases emitted by the burner, a two stage gas regulator having a low setting for delivering a low gas flow to the burner and a high setting for delivering a high gas flow to the burner; and a two stage blower *positioned on the exterior of the housing and* having a low speed for delivering a low air flow to the inlet of the burner and a high speed for delivering a high air flow to the inlet of the burner wherein the method comprises the steps of; (i) operating the blower at the low speed while operating the regulator at the low setting to heat the room; and (ii) operating the blower at the high speed while operating the regulator at the high setting to heat the room.

21. A method of heating a room with an infrared heater of the type including a *housing having an interior and an exterior and a* burner *positioned within the housing and* having an inlet for receiving an air and gas mixture and an exhaust for emitting exhaust gases generated by combustion within the burner, an elongated radiant heating tube *extending from the housing and* having an inlet for receiving the exhaust gases emitted by the burner, a gas flow control assembly for controlling the flow of gas to the burner, and a two stage blower *positioned on the exterior of the housing* for controlling the flow of air to the burner, the method comprising the steps of: defining a temperature set point of the room; defining a programmed temperature differential; monitoring the temperature of the room; igniting the burner when the room temperature is less than the temperature set point; defining a temperature threshold as the temperature set point minus the temperature differential; operating the blower at the high level when the room temperature is equal to or below the temperature threshold; and operating the blower at the low level when the room temperature is greater than the temperature threshold and lower than the set point temperature.

* * * * *